US008540564B2

(12) United States Patent
Berkowitz

(10) Patent No.: US 8,540,564 B2
(45) Date of Patent: Sep. 24, 2013

(54) SLOT MACHINE GAMING DEVICE AND METHOD OF PLAY

(75) Inventor: Norman G. Berkowitz, Slatington, PA (US)

(73) Assignee: Markman Holdings, LLC, Las Vegas, NV (US)

( * ) Notice: Subject to any disclaimer, the term of this patent is extended or adjusted under 35 U.S.C. 154(b) by 1067 days.

(21) Appl. No.: 12/267,953

(22) Filed: Nov. 10, 2008

(65) Prior Publication Data

US 2009/0156294 A1 Jun. 18, 2009

Related U.S. Application Data

(60) Provisional application No. 61/002,497, filed on Nov. 9, 2007.

(51) Int. Cl.
*G07F 17/32* (2006.01)

(52) U.S. Cl.
USPC ..... 463/20; 463/16

(58) Field of Classification Search
USPC ..... 463/16, 20
See application file for complete search history.

(56) References Cited

U.S. PATENT DOCUMENTS

| | | | | |
|---|---|---|---|---|
| 5,816,918 | A * | 10/1998 | Kelly et al. | 463/16 |
| 6,425,824 | B1 * | 7/2002 | Baerlocher et al. | 463/16 |
| 6,702,670 | B2 | 3/2004 | Jasper et al. | |
| 2001/0008843 | A1 * | 7/2001 | Walker et al. | 463/16 |
| 2003/0060276 | A1 * | 3/2003 | Walker et al. | 463/25 |
| 2003/0216169 | A1 | 11/2003 | Walker et al. | |
| 2003/0228901 | A1 | 12/2003 | Walker et al. | |
| 2004/0077422 | A1 | 4/2004 | Bryant et al. | |
| 2006/0189371 | A1 * | 8/2006 | Walker et al. | 463/16 |

* cited by examiner

*Primary Examiner* — Omkar Deodhar
(74) *Attorney, Agent, or Firm* — Charles A. Wilkinson; Clinton H. Wilkinson

(57) ABSTRACT

A method of playing a slot machine game in which a two level or stage play is conducted, the first level providing winnings in the normal stage of slots, but where the losers are automatically entered into a second stage of play as a bonus play in which there is a possibility of a large payout as well as the guarantee that there will be at least a small payout.

6 Claims, 2 Drawing Sheets

SLOT MACHINE GAMING DEVICE AND METHOD OF PLAY

CROSS REFERENCE TO RELATION APPLICATION

This application claims priority to and claims the benefit of U.S. provisional application 61/002,497 filed on Nov. 9, 2007, the disclosure of which is hereby incorporated by reference in its entirety.

1 FIELD OF THE INVENTION

The present invention relates to electronic gaming devices of the type installed in casinos and the like and methods of using the same, and more particularly to an electronic gaming device and method of playing a slot machine game having two consecutive game play routines wherein for each turn a player is automatically awarded a payout in the second routine if such player is not awarded a payout in a first routine.

2. BACKGROUND OF THE INVENTION

Casino gaming devices such as electronic slot machine games and video poker have become extremely popular, and profitable, and continue to increase in popularity. While traditional gambling games such as poker, blackjack, and craps are fairly complicated and require at least a minimum level of gambling knowledge, which results in many people being turned off by such gambling games, slot machine games require little or no gambling knowledge. Gaming machines now account for a large percentage of casino profits, and numerous casinos have opened having exclusively gaming machines and no traditional table games.

In both mechanical slot machines and newer computer-controlled electro-mechanical machines, the player after accruing one or more credits by placing money or tokens in the machine takes a turn by pulling a handle or pressing a spin button, which causes a series of reels having pictures, symbols, or other images on their faces to rotate. In computer-controlled slot machines, the reels are typically spun by step motors driven by short digital pulses of electricity that precisely turn each reel a certain distance and stop at a predetermined point, while the older mechanical machines are controlled by a series of gears and levers. The outcome of each pull in computer controlled reel type machines is determined by a controlling processor in combination with a random number generator, and the result is displayed on a display screen. Video slot machines are also increasingly popular. While video slots have the appearance of operating in the same way as conventional reel-type machines, instead of having actual rotating wheels a video monitor displays an image such as an image of the reels spinning. In addition, both the stop position and resulting image were decided for each "reel" by a random number generator means at the time the start button was pressed. In both reel type machines and video slot machines, whether or not the player has a winning turn is based on whether one or more predetermined combinations of images or winning outcomes have resulted, and if a winning combination is displayed, a predetermined payout or award is issued to the player by the processor, and the player is free to play or spin again.

The odds of winning an award in a conventional slot machine game may be increased somewhat simply by playing more credits for each turn, which increases the number of pay lines that are played at one time, although the overall payout percentage for the machine is preset. Various payout schemes are common in modern slot machines. Standalone flat-top or straight-shot machines have a set payout amount that rarely changes, while in progressive machines, the jackpot increases as the machine is played and players put more money into the machine, until the jackpot is won and the machine resets itself. A plurality of progressive machines may also be linked to a single computer system, enabling the machines to be located in the same casino, different casinos in the same city, or even different cities across the country or world, all of which machines contribute to a single large jackpot payout. In an effort to increase the entertainment value and attractiveness of casino games to players and to entice players to continue playing the game for longer periods, thus spending more money, most slot machine games today also include some type of "bonus" round or payoff. More particularly, the bonus game is entered into upon the occurrence of a certain result or results in the first game.

While prior art slot machines games thus have an entertainment value and are generally suitable for their particular purposes, players quickly become bored with existing games and there is always a need for a new game system or method. The game of the present invention meets such need, and has the unique advantage that a player is a winner on each and every "pull" of a handle or "push" of a play button, either through a first stage of play or play routine or, if such player is not successful in the first stage or routine, through a second stage of play or play routine that automatically awards the player a prize. Despite the wide variety of known casino games, as far as the present inventor is aware, there is no game wherein the player is a guaranteed a payout or award in each and every turn, either in the first stage of play or second stage of play. The game system and method of the present invention will be described herein with reference to a video slot machine of a type known to those skilled in the prior art that displays a plurality of reel images on a monitor. However, it will be understood that such game system and method could be equally well adapted for use with electro-mechanical computer controlled reel type slot machines as well as the older mechanical slot machines as well as other variations.

OBJECTS OF THE INVENTION

It is therefore a primary object of the present invention to provide a gaming device and associated method of play wherein every "pull" of the lever or push of the play button of said gaming device results in winnings.

It is a further object of the present invention to provide a slot machine game wherein if upon a "pull" of the lever or push of the play button a winning combination does not result in a first stage of play or play routine, such player is then automatically awarded a payout or prize in a second stage of play or play routine, and the payout or prize awarded in the second stage or routine is on average greater than the average payouts or prizes awarded in the first stage or routine.

If is a still further object of the present invention to provide a method of play of a slot machine game wherein if upon a "pull" of the lever or push of the player button of such slot machine a winning combination does not result, such player then is guaranteed to receive a "Bonus" payout or prize.

It is a still further objection of the present invention to provide a slot machine game having two consecutive stages or routines of play in which the first stage or routine may or may not provide a win, but if a win is not made in the first stage or routine, a second stage or routine may be entered into in which a win of some sort is guaranteed, and in addition while wins in the first stage or routine may be less than the price to play, less frequent but on average much larger winnings may be granted in the second stage or routine.

Still other objects and advantages of the invention will become clear upon review of the following detailed description in conjunction with the appended drawings.

SUMMARY OF THE INVENTION

The foregoing objects are attained in the present invention by providing gaming device and associated method of play preferably in the form of a slot machine having a play cycle in which every turn results in a payout of some amount to the player, even if such amount is less than the price of entering the game or participating therein, but in which there are occasional high wins. In a preferred version of the game there are two consecutive play operations, the first usually resulting in a payout of some degree to the player, although in most instances such payout will be less than the price of play, while there are occasional high wins to maintain the interest of the player, and the second operation or stage wherein the player is awarded a payout automatically if a loss is encountered in the first operation or stage, so that every play results in winning of some degree.

DESCRIPTION OF THE PREFERRED EMBODIMENTS

The following detailed description is of the best mode or modes of the invention presently contemplated. Such description is not intended to be understood in a limiting sense, but to be an example of the invention presented solely for illustration thereof, and by reference to which in connection with the following description and the accompanying drawings one skilled in the art may be advised of the advantages and construction of the invention.

Figure 1:
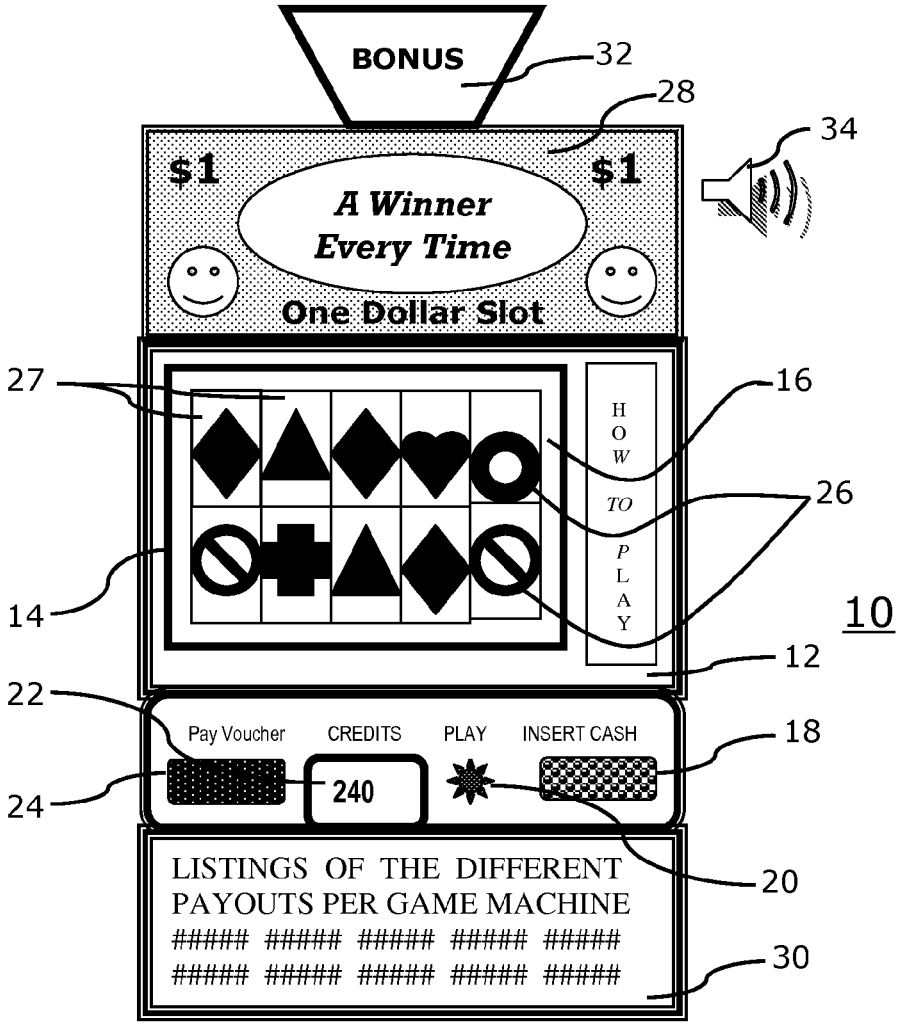
FIG. 1 depicts an elevation view of the front panel of a video slot machine illustrating the game system and method of the present invention wherein the reel images on the display unit show a winning result.

While the game device and method of the invention can be provided in a number of variations and forms, such as a mechanical or reel type slot machine of which there are various types, a preferred embodiment of the invention will be described herein in connection with a video slot machine or game device of a type that would be installed in a casino. FIG. 1 is an external front view of a gaming device according to the present invention. Slot machine 10 has a box-shaped housing (not completely shown), the front panel 12 of which is shown in FIG. 1, which front panel 12 is attached to the housing and may open and close on hinges or the like such as for servicing of the machine. Front panel 12 includes a display window 14 in which a display unit 16 is arranged to be visible from the exterior; a money or bill insertion slot 18 comprises a currency receiving unit, a play button 20 is situated next to bill slot 18; a credit display 22 for displaying the amount of credit corresponding to the amount of money inserted into machine 10 by the player and remaining as a credit at any time during game play, and a pay voucher slot 24 for cashing out one's remaining credit when a player decides to end play.

Figure 2:
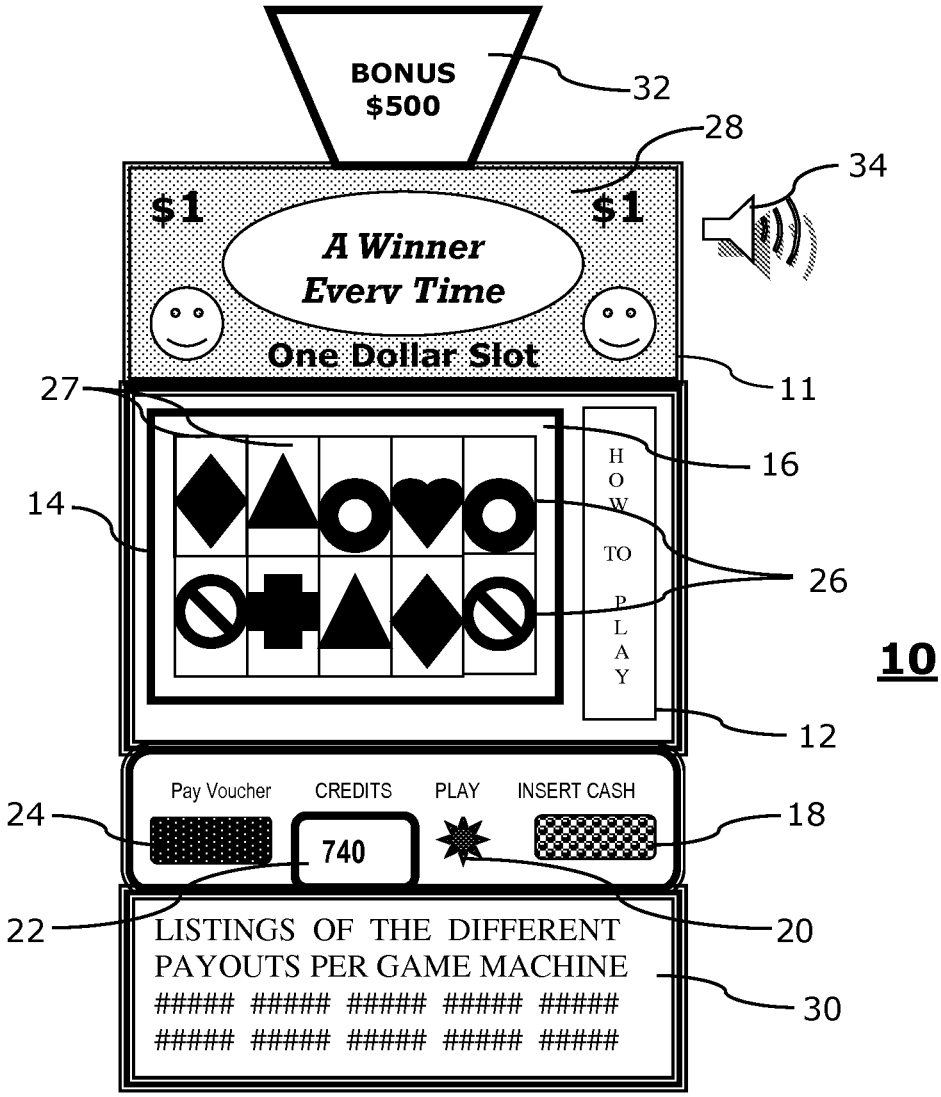
FIG. 2 depicts an elevation view of the front panel of a video slot machine illustrating the game system and method of the present invention wherein the reel images on the display unit do not show a winning result, but the player has nevertheless been awarded a bonus prize.

Display unit 16 is preferably a monitor mounted in the slot machine housing, and is preferably a liquid crystal display, but may be a plasma display, CRT monitor, or other type of display such as a touch screen. Shown on display unit 16 are several different kinds of symbols 26 arranged in a predetermined order in twelve different display areas 27 arranged in two rows on the monitor. Above display unit 16 on front panel 12 is an advertising area 28 which may include information about the game as well as other indicia to entice players to the game and which is preferably illuminated with a lamp or the like situated behind such area and controlled by a light controller, although any type of indicia and light arrangement could be provided here. A list of the winning payouts for video slot machine 10 is provided near the bottom of front panel 12 in area 30, so that players can easily determine the number of credits or amount of winnings that should be awarded for certain combinations of results per turn. Such information could of course be provided in any other suitable area of front panel 12. A second housing 32 with the word "Bonus" visible on the front of such housing is mounted to the top of the slot machine housing, which second housing 32 preferably includes a small display monitor that displays a "Bonus" amount won during game play, as shown in FIG. 2. One or more speakers 34 are also mounted in housing 11 and are connected to a sound controller.

A separate slot for inserting a casino "house card" into the slot machine of a known type may also be provided in machine 10. Such cards contain basic identification information about the holder of the card and are used by casinos for managing personal information about players. For example, casino management can use such cards to keep track of the amount of money spent by players, and then to offer extra or complementary services to some players as an added incentive to continue patronizing the casino, such as eligibility for discounts, tournaments, cash back awards, complimentary dining and entertainment, and the like. The slot machine may also be arranged so that the house card may be inserted and read in pay voucher slot 24.

The internal operation of video slot machine 10 is of a type well known in the prior art wherein generally a central processing unit (CPU) or main controller is provided, along with an I/O port, ROM, RAM, a random number generator, a display controller, an illumination controller, a sound controller, and any other required sub-controllers to operate further features of the machine. In general, the I/O port is used for data communication with a sub-controller. The ROM stores data to be utilized by the CPU, such as various programs, tables, and databases, and outputs the data to the CPU. The RAM temporarily stores variable number data computed by the CPU. The random number generator generates a random number periodically and outputs the data to the CPU. The display controller and the monitor comprise the display unit, and under the control of the CPU, the display control unit controls the display operation of the monitor, which displays the symbols 27 in display areas 26 and the like. The illumination controller controls illumination of areas 28 and 30, as well as possibly other display areas, under the control of the CPU. The sound controller controls any voice announcements, music, sound effects and the like output through speaker 32, also under the control of the CPU.

The CPU of the main controller is connected to an operation unit that comprises the play button 20 for executing a start operation, as well as any other buttons or devices for executing game play operations. In one embodiment, the game will include a separate credit button that the player will press a certain number of times per turn to indicate the number of credits to be placed in a bet in play of the game, after which the play button 20 is pressed to start the game. A currency counting device is also connected to and under the control of the CPU. If the machine includes a slot for a house card a separate sub-controller system to read and store information on and about the card would also be provided, which systems are well known in the prior art.

To play the game, cash is inserted into currency slot 18, and a counter will count the amount inserted, which data is output to the CPU of the slot machine main controller. Such data is stored and displayed in credit display 22 indicating the amount of credit that corresponds to the amount of money inserted. Alternatively, a credit card slot may be provided, or credit data may be present on a casino house card, in which cases a similar arrangement of a type known in the prior art would be provided for slot machine 10 to deduct the indicated amount from the cards and then read and display such data.

As indicated above, a player desiring to play a certain credit amount will press the play button 20, and if variable select the amount of credits to be played preferably pressing a separate "bet" button, which information in either case is transmitted to the CPU of the main controller. When the play button 20 is pressed, the CPU of the main controller serves as a credit processing unit, and executes the play process by reducing the number or amount of credit in the RAM by the number or amount selected for play. The CPU then serves as a start signal generator, and will generate and send a start signal to the display controller. The display controller upon receiving the start signal, in turn signals and controls a display operation in which the symbols 27 are successively changed and displayed on each of the symbol display areas 26 on monitor 16, essentially by successively displaying each of the symbols comprising the reel images, or if not simulative of reels simply by successively displaying the possible symbols. In the presently described embodiment, as shown in FIGS. 1 and 2, there are six different symbols, which are a diamond, a triangle, a circle, a heart, a circle with a line through it, and a plus symbol.

The CPU will also send the start signal mentioned above to the random number generator, which after receiving the start signal will generate twelve random numbers, one for each of the twelve symbol display areas 26. In one possible embodiment, the CPU and random number generator function as a determination unit, and the CPU will compare the random numbers with stop position tables stored in the ROM after receiving such numbers from the random number generator. A stop position table is prepared for each of the reel images of the symbol display areas 26, so that one stop position table in which each image comprising a reel image is matched with random number values. Each of the random numbers and each of the stop position tables determine the stop positions of each of the changing displays in the symbol display area. The twelve random numbers sent from the random number generator thus determine the symbols to be displayed in the symbol display area. Other arrangements for using the random number generator to determine the symbols displayed may be substituted for the presently described embodiment.

The CPU serves also as a prize winning determination unit in combination with the random number generator, and thus receives the random numbers sent from the random number generator. A determination is then made by the CPU whether or not a combination of the random numbers will win a predetermined prize by comparing them with a prize winning determination table also stored in ROM. In other words, the combination of the random numbers and prize determination tables are used by the CPU to determine if a prize is won. At least two types of prize determination tables will be required; one for executing the first game routine or stage of game play that is used with respect to the generation of symbols 26 and another for the second game routine or stage of play in which a bonus prize is awarded if a winning combination is not achieved in the first stage of play, as explained below.

The CPU will then stop the changing displays in display areas 27 based on the stop positions that have been determined. The predetermined symbols corresponding to the twelve random numbers will thus be displayed in their associated display area. At no the same time, the CPU may signal the illumination controller and sound controller to affect certain predetermined effects, such as flashing lights, music, and the like. In the present game method, three like kind symbols or more are required to win a prize in the first stage of play, presently being described. Thus, as shown in FIG. 1, where there are three diamonds displayed in the twelve symbol areas, the player will win the number of credits, payout, or prize determined by the CPU; in this example 240 credits are awarded for such combination, although such amount will, more often than not, likely be less than the amount played by the player but will be something. This is accomplished in general by the CPU sending new credit data that is added to that data already in RAM.

If, as shown in FIG. 2, the result of a play in execution of the first game routine or stage of play is that no three like symbols or more result from the above-described process, a second game routine or stage of play is activated and such "Bonus" routine will be carried out by the CPU of the main controller, which process may also include different predetermined signals being sent to the illumination controller and sound controller. Rather than a second "free spin", bonus line, or the like being carried out as may occur in prior art game systems of methods, in the present game the player is automatically awarded a bonus prize or payout of some amount, which, for example, as shown in FIG. 2 may be equal to a monetary award of $500. Such bonus payout amount can be any randomly selected number or amount, but will in every case be something, although in most cases will preferably be significantly more than the amount originally bet by the player. To accomplish this, a sequence similar to that described above is carried out by the CPU wherein a random number generator is utilized in combination with a bonus prize table to determine the amount of the bonus prize. After the play or turn has been completed, the number of total credits for the player will be updated and the CPU will ready the slot machine for a next turn or game. In credit display area 22, note that in the instance described, the $500 Bonus has been added to the credits in the form of 500 additional credits.

The effective result of the present inventor's method of game play is that every complete play or turn by a player is a winner, wherein the player will be awarded either the prize indicated by the winning combination of symbols in the first game operation or stage of play, or, if there are no winning combinations in the first stage of play, the player will automatically be awarded a bonus prize in a second game operation or stage of play. It should be noted that the amount of the bonus prize is preferably significantly greater on average than the average prize to be won in the first stage of play, but also is less frequently awarded. The payout tables of the gaming device would be adjusted so that while every play results in a payout to the player, on average a certain percentage of cash that is input into the machine will be returned to a player, while the remainder goes to the casino. Thus, a predetermined payout ratio, such as a range of 88% to 94%, which can be adjusted, will be provided.

In addition, as indicated above, since in accordance with the game of the bonus slot machine invention each play by a user of the machine will result in the payment of some award, either as an initial payout prize in the normal range of slot payouts given more frequently, or a bonus prize amount which may be of higher amount or payout in a second mode of play, but will in every case be something, although by necessity will be less than the play amount for most players or the majority of plays or turns, such amounts will be fairly small and might even be left in the machine or the vouchers discarded by the player as a sign of "disdain" by those players who either are, or fancy themselves, as "high rollers."

While the present invention has been described at some length and with some particularity with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the invention.

I claim:

1. A method of play of a slot machine game comprising the steps of:

(a) upon the application of a required monetary amount to initiate play of the game, entering a first stage of play in which one or more levels of payments are made on a random basis upon the occurrence of a winning combination, and if a winning combination occurs the indicated winnings are awarded and the game is ended and;

(b) if a winning combination does not occur being eligible to enter a second bonus stage of play in which stage a bonus payment is always awarded, after which said game is ended;

(c) said first stage of play usually resulting in the occurrence of a winning combination, and (d) said bonus payments in said second stage of play usually being greater than the amount of said required monetary amount to initiate play of the game.

2. A method of play of a slot machine game in accordance with claim 1 wherein the more substantial or winning bonus payments in the second level of play are greater than the winning payments in the first level of play.

3. A method of play of a slot machine game in accordance with claim 1 where the majority of payments made in the first mode of play are less than the monetary amount required to initiate play of the game, with occasional high payouts.

4. A slot machine-type game having two consecutive play routines comprising:

(a) a first level of play during which in each game winnings are credited to players on a variable random basis in a turn, and (b) a second bonus level of play in which for said turn only players who do not accumulate winnings in said first level of play in a turn are eligible to participate in, which players are automatically awarded winnings in said second level of play, the amount of winnings in the second level of play being awarded on a variable random basis, (c) said first level of play usually resulting in the accumulation of winnings, and (d) said winnings awarded in said second stage of play usually being greater than the monetary amount required to initiate play of the game.

5. A method of playing a slot machine game, comprising the steps of:

(a) initiating play of said game, each round of said game having a first stage of play and a second stage of play, wherein play of the second stage of play is predicated upon the results of play in the first stage of play;

(b) the player playing the first stage of play of said game, and if the player is a winner in the first stage of play, the round ending without the player playing the second stage of play; and (c) only in the event the player is not a winner in the first stage of play, playing the second stage of play, in which second stage of play the player is guaranteed to be a winner, after which the round is ended, and (d) the player receiving an indicated winning or award from either said first stage of play or said second stage of play (e) said first stage of play usually resulting in the occurrence of a winning combination, and (f) said bonus payments in said second stage of play usually being greater than the amount of said required monetary amount to initiate play of the game and being more likely to result in larger value payouts.

6. A method of playing a slot machine game in accordance with claim 5 in which the second stage of play comprises the player automatically being awarded a bonus payment.

* * * * *